US009222696B2

(12) United States Patent
Lesage

(10) Patent No.: US 9,222,696 B2
(45) Date of Patent: Dec. 29, 2015

(54) INTEGRATED WATER HEATING SYSTEM WITH SUPPLY RESERVOIR

(71) Applicant: MICLAU—S.R.I. INC., Montreal (CA)

(72) Inventor: Claude Lesage, Pointe Claire (CA)

(73) Assignee: MICLAU—S.R.I. INC.

( * ) Notice: Subject to any disclaimer, the term of this patent is extended or adjusted under 35 U.S.C. 154(b) by 350 days.

(21) Appl. No.: 13/966,412

(22) Filed: Aug. 14, 2013

(65) Prior Publication Data

US 2015/0047578 A1 Feb. 19, 2015

(51) Int. Cl.

| | |
|---|---|
| ***F24H 9/06*** | (2006.01) |
| ***F24H 1/08*** | (2006.01) |
| ***F24H 1/10*** | (2006.01) |
| ***F24H 1/18*** | (2006.01) |
| ***F24H 9/20*** | (2006.01) |

(52) U.S. Cl.

CPC .. *F24H 1/08* (2013.01); *F24H 1/10* (2013.01); *F24H 1/182* (2013.01); *F24H 9/06* (2013.01); *F24H 9/2007* (2013.01)

(58) Field of Classification Search

CPC ..... F24H 1/18

USPC ..... 122/19.2, 494, 19.1, 20 R, 20 A; 220/567.3, 495.01, 694.1; 126/344

See application file for complete search history.

(56) References Cited

U.S. PATENT DOCUMENTS

| | | | | | |
|---|---|---|---|---|---|
| 1,846,505 | A * | 2/1932 | Wier | F24H 9/0042 | 122/23 |
| 2,223,215 | A * | 11/1940 | Kunz | F22B 37/36 | 122/494 |
| 3,709,198 | A * | 1/1973 | Williams | A47J 36/26 | 122/17.1 |
| 4,917,077 | A * | 4/1990 | Scanferla | F24H 9/14 | 126/344 |
| 5,607,133 | A * | 3/1997 | Markham | F24H 9/06 | 248/146 |
| 6,926,243 | B1 * | 8/2005 | Ziaylek | A62B 25/00 | 248/307 |
| 6,951,191 | B1 * | 10/2005 | Lin | F24H 1/145 | 122/13.01 |
| 2006/0257127 | A1 * | 11/2006 | Patterson | F24H 9/2021 | 392/441 |
| 2012/0067301 | A1 * | 3/2012 | Braathen | F24H 9/02 | 122/19.1 |
| 2013/0042635 | A1 * | 2/2013 | Nelson | F24H 1/205 | 62/79 |

* cited by examiner

*Primary Examiner* — Gregory A Wilson
(74) *Attorney, Agent, or Firm* — Guy J. Houle

(57) ABSTRACT

An integrated water heating system is comprised of a hot water holding tank having an outer jacket secured in spaced relationship therearound. An insulating space is defined about the hot water holding tank and the outer jacket. A connecting bracket is secured to an outer surface of the hot water holding tank and has a projecting formation provided with an arcuate connecting wall spaced a predetermined distance from the outer surface for close fit adjacent an inner surface of the outer jacket and disposed for alignment with an external support bracket adapted to be secured thereto through the outer jacket. Thermal insulating material is disposed in the insulating space and about the connecting bracket. An external water heating device is removably supported by the external support bracket. A pump circulates water through the water heating device and through the hot water holding tank.

12 Claims, 3 Drawing Sheets

INTEGRATED WATER HEATING SYSTEM WITH SUPPLY RESERVOIR

TECHNICAL FIELD

The present invention relates to an integrated water heating system with a supply reservoir whereby to provide hot water on demand.

BACKGROUND ART

It is known to provide reservoirs for holding large quantities of hot water and we find these mostly in boiler systems. With the advent of tankless water heaters, however, it is difficult to supply a large demand of hot water unless several of these tankless water heaters are used and controlled by an intelligent controller circuit and this becomes a costly system. An example of such system is described in U.S. Patent Publication No. 2008/0152331, entitled "Modular Water Heating Systems", wherein a water storage tank is fed hot water by two or more tankless water heaters which are supported on a frame. Such an installation takes a large space to install and requires a frame. It is also not aesthetically pleasing and there is an added cost to assemble the frame with the tankless water heaters and the whole system needs to be transported and assembled on site.

There is a need to provide an integrated water heating system using an insulated holding tank and to which is removably secured a tankless water heater in such a manner that the integrated system becomes a self-supporting unit capable of being transported and wherein the installation thereof simply requires a connection to the domestic water supply and to the hot water supply line.

SUMMARY OF INVENTION

It is therefore a feature of the present invention to provide an integrated water heating system with a supply reservoir which meets the above need.

According to a broad aspect of the present invention there is provided an integrated water heating system comprised of a hot water holding tank having an outer jacket secured in spaced relationship therearound. An insulating space is defined about the hot water holding tank and the outer jacket, A connecting bracket is secured to an outer surface of the hot water holding tank and has a projecting formation provided with a connecting member spaced a predetermined distance from the outer surface for close fit adjacent an inner surface of the outer jacket and disposed for alignment with an external support bracket adapted to be secured thereto through the outer jacket. A thermal insulating material is disposed in insulating space and about the connecting bracket. An external water heating device is removably supported by the external support bracket, A pump and conduit means is provided to circulate water from a bottom portion of the hot water holding tank, through the water heating device and into the hot water holding tank. Control means is provided to regulate the temperature of the water in the hot water holding tank.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
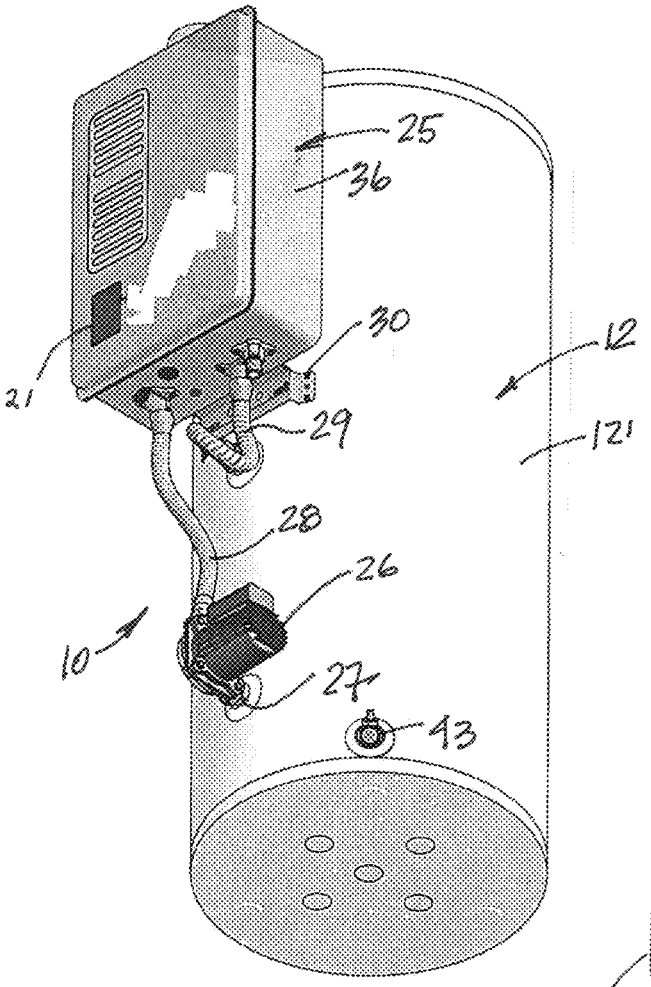
FIG. 1 is a perspective view of the integrated water heating system of the present invention as viewed from below.
Figure 3:
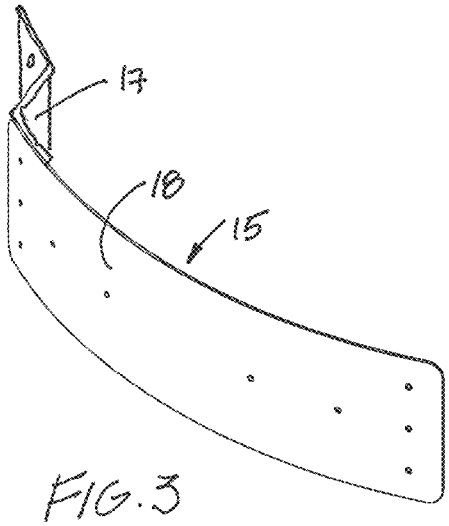
FIG. 3 is a perspective view showing the construction of the connecting member located inside the outer jacket and spaced from the water holding tank.
Figure 2:
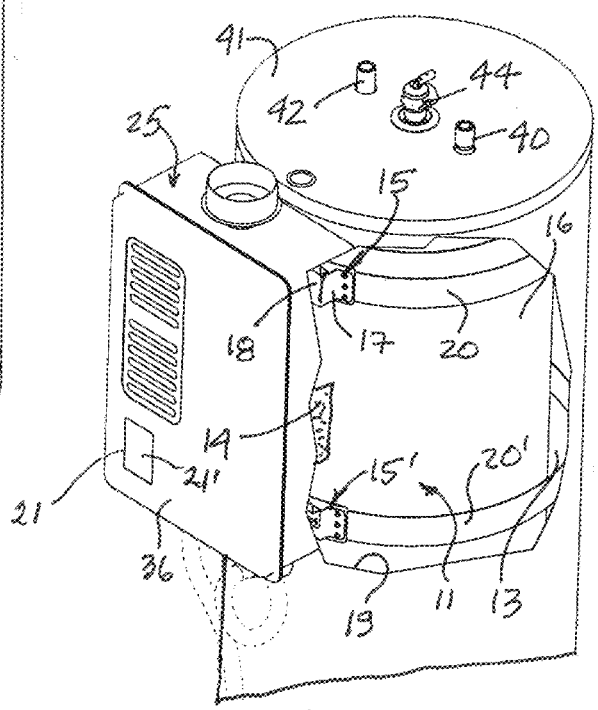
FIG. 2 is a fragmented perspective view illustrating the construction of the hot water holding tank and the connecting bracket attachment to the hot water holding tank.
Figure 4:
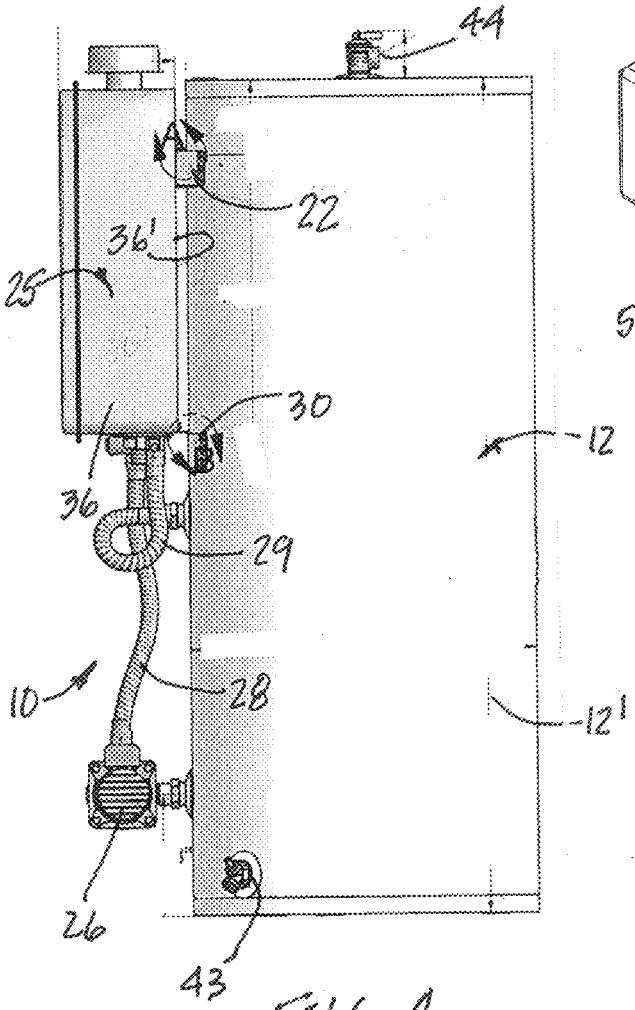
FIG. 4 is a side view of the integrated water heating system showing the removable connection of the water heating device to the outer jacket surrounding the hot water holding tank.
Figure 5A:
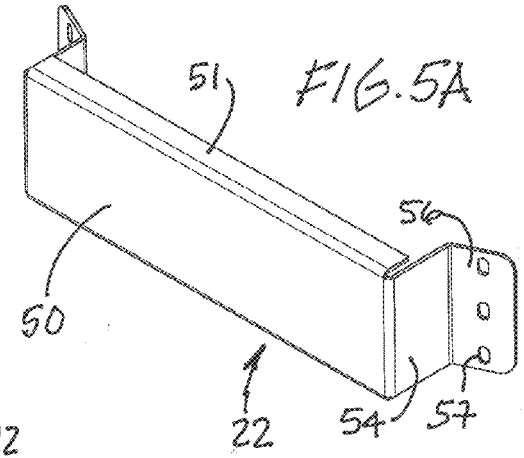
FIG. 5A is a perspective view, as seen from below, of the external support bracket.
Figure 5B:
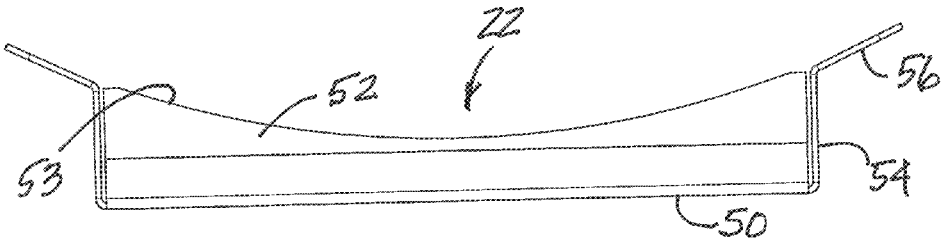
FIG. 5B is a top view of the external support bracket.

Referring now to the drawings and more particularly to FIGS. 1 to 3, there is shown generally at 10 an integrated water heating system constructed in accordance with the present invention. As hereinshown, it comprises a hot water holding tank 11 which in this particular instance is the inner casing of a conventional hot water heater of the 40, 60 or 119 gallons storage capacity and which is surrounded by an outer jacket 12 spaced thereabout to create an insulating space 13 in which is injected a urethane foam 14 which expands and becomes rigid. However, before doing so a connecting bracket 15 is connected to an outer surface 16 of the hot water holding tank 11 and has spaced projecting formations 17, as better illustrated in FIG. 3, across which is secured an arcuate connecting flange wall 18 which is spaced a predetermined distance from the outer surface 16 of the holding tank whereby to be positioned in close fit adjacent an inner surface 19 of the outer jacket 12. As shown in FIG. 2, the connecting bracket 15 is secured to the hot water holding tank 11 by a metal strap 20 to which the connecting bracket 15 is secured. The arcuate connecting plate 18 is positioned for alignment with an external support bracket 22 as shown in FIGS. 4, 5A and 5B.

When the thermal insulating foam 14 is injected within the insulating space 13 and solidifies, it holds the connecting bracket and strapping captive within the insulating space 13. The rigid insulating foam also provides thermal insulation in the space 13 and at the same time provides support bracing between the outer jacket 12 and the outer surface of the hot water holding tank or inner casing 11.

Figure 6:
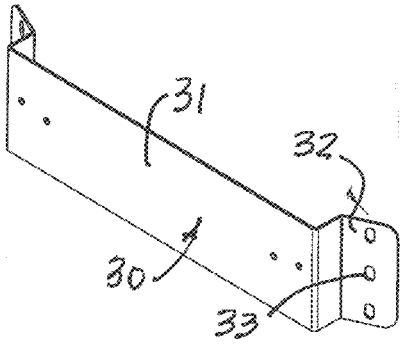
FIG. 6 is a perspective view of the abutment bracket secured to the outer surface of the outer jacket and aligned with the external support bracket.

As shown in FIGS. 1 and 6, an external hot water heating device, herein a tankless hot water heater 25, is removably supported by the external support bracket 22. A pump 26 is connected to an outlet conduit 27 which connects to a bottom portion of the hot water holding tank 11 and pumps water from the bottom of the holding tank 11 via an inlet conduit 28 and into the tankless hot water heater 25 where the water is heated, then fed back into the holding tank 11 by an outlet conduit 29 whereby to release hot water in the top portion of the hot water holding tank 11. However, the hot water may be fed at another location of the holding tank. A control circuit 21 having a display panel 21' regulates the temperature of the water in the hot water holding tank. This control is an intelligent control module having a micro-controller having a temperature regulating program. A thermistor (not shown) is mounted inside the water holding tank in a bottom portion thereof and feeds temperature signals to the micro-controller. The micro-controller has inputting means, such as touch-switch, to set a desired temperature of water within the hot water holding tank. This controller is of a type well known in the art.

It is pointed out that another type of water heater may be provided such as a heat exchanger device fed from an external source or another type of gas or electric water heater. The control circuit may be integrated with the water heating device 25 or be a separate unit.

As pointed out hereinabove, the hot water holding tank 11 may be that of a conventional hot water heater which is retro-fitted by removing the resistive heating elements and other associated devices. By using a retro-fitted conventional hot water heater, there is a reduction in costs for the construction of the integrated water heating system of the present invention.

Figure 8:
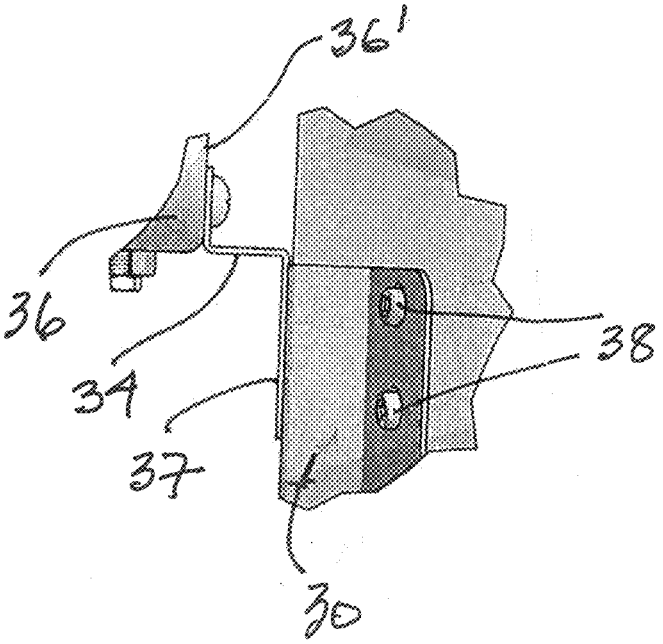
FIG. 8 is a fragmented view showing an abutment flange secured at a bottom end of the water heating device housing for abutment against the abutment bracket secured to the outer jacket.

Referring to FIGS. 1 and 2, it can be seen that an abutment bracket 30 is also secured to the outer surface 12' of the outer jacket 12 and is vertically aligned with the external support bracket 22, as shown in FIG. 4. The abutment bracket 30 is formed of a metal strip which defines a flat connecting or abutting wall 31 which is bent at opposed ends to form angled connecting flanges 32. The connecting flanges are provided with holes 33 to receive tapping screws 38. As shown in FIG. 8, an abutment flange 34 is secured to a bottom end 35 of the tankless water heater housing 36 and has a spaced depending flange wall 37 for abutment against the abutment plate 31 of the abutment bracket 30. It is pointed out that the depending flange 37 may also be provided with holes therein whereby to be rigidly connected to the abutment bracket 30. Further, as shown in FIG. 2, the abutment bracket 30 may be secured to a further connecting bracket 15' secured to the hot water holding tank 11 by a metal strap 20' in a similar fashion as the connecting bracket 15 whereby the abutment bracket is also supported by the hot water holding tank 11 which is a very rigid steel tank, thus providing added support to the tankless hot water heater. However, it is to be noted that the metal strapping 20 and its associated connecting bracket provides about 440 lbs of resistance before compression and the tankless hot water heater 25 usually weighs about 75 lbs. Accordingly, two or three of these tankless hot water heaters could be connected about the outer casing with the provision of additional connecting brackets 15 disposed inside the outer jacket. Of course, the water holding tank 11 would be of larger capacity.

Figure 7:
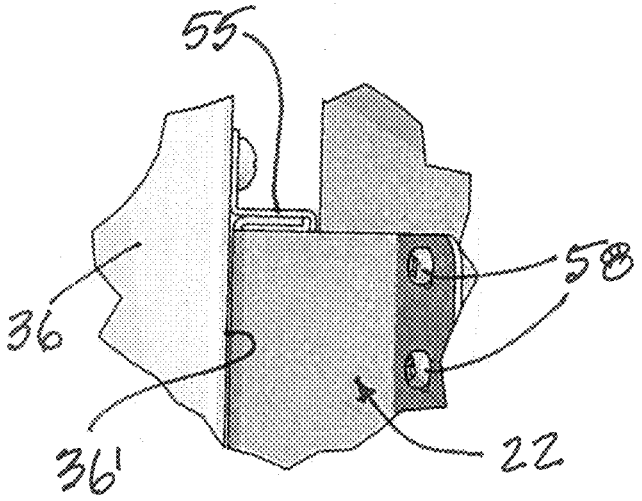
FIG. 7 is a fragmented view showing the connection of the external water heating device to the exterior support bracket and wherein a hanging flange is secured to the housing of the water heating device to be hung onto the external support bracket.

Referring to FIGS. 5A and 5B, there is shown the construction of the external support bracket 22, This bracket is formed from a metal sheet stamping and defines an abutment wail 50 against which the back wall 36' of housing 36 abuts when hung over this abutment wall 50, as shown in FIG. 7. The abutment wall is solidified by a straight angle flange 51 at a top end thereof and an outer jacket right angle lower flange 52 at a bottom end thereof. The lower angle flange 52 has an arcuate edge 53 to fit the curvature of the outer casing 12 for abutment thereagainst. Side flanges 54 are provided with connecting wings 56 provided with holes 57 to receive tapping screws 58, as shown in FIG. 7 for connecting the support bracket 22 to the connecting bracket 15 through the outer surface 12' of the outer casing 12. As shown in FIGS. 4 and 7, the inner wall 36' of the water heating device housing 36 is provided with a hanging flange 55 which is dimensioned to hook the water heating device 25 on the flange 51 of the bracket 22.

As shown in FIGS. 1, 2 and 4, the hot water holding tank 11 is provided with a domestic water supply connection 40 which extends through the top wall 41 of the outer jacket 12. A hot water outlet connection 42 also extends through this top wall 41 to supply hot water. A conventional drain conduit 43 is secured to a bottom end of the hot water holding tank 11, as shown in FIG. 4, whereby to drain water from the tank. A pressure relief valve 44 is secured to a top end of the outer casing.

Referring to FIGS. 5A and 5B, there is shown the construction of the external support bracket 22. This bracket is formed from a metal sheet stamping and defines an abutment wall 50 against which the back wall 36' of housing 36 abuts when hung over this abutment wall 50, as shown in FIG. 7. The abutment wall is solidified by a straight flange 51 at a top end thereof and an outer jacket right angle lower flange 52 at a bottom end thereof. The lower flange 52 has an arcuate edge 53 to fit the curvature of the outer casing 12 for abutment thereagainst. Side flanges 54 are configured for connecting the support bracket 22 to the connecting bracket 15 through the outer surface 12' of the outer casing 12. As shown in FIGS. 4 and 7, the inner wall 36' of the water heating device housing 36 is provided with a hanging flange 55 which is dimensioned to hook the water heating device 25 thereunto.

It is within the ambit of the present invention to cover any obvious modifications of the preferred embodiment described herein, provided such modifications fall within the scope of the appended claims.

The invention claimed is:

1. An integrated water heating system comprising a hot water holding tank having an outer jacket secured in spaced relationship therearound, an insulating space defined about said hot water holding tank and inside said outer jacket, a connecting bracket connected to an outer surface of said hot water holding tank and having a projecting formation provided with a connecting member spaced a predetermined distance from said outer surface for close fit adjacent an inner surface of said outer jacket and disposed for alignment with an external support bracket adapted to be secured thereto through said outer jacket, a thermal insulating material disposed in said insulating space and about said connecting bracket, an external water heating device removably supported by said external support bracket; a pump and conduit means to circulate water from a bottom portion of said hot water holding tank, through said water heating device and into said hot water holding tank; and control means to regulate the temperature of said water in said hot water holding tank.

2. An integrated water heating system as claimed in claim 1 wherein said hot water holding tank is an inner tank of a conventional domestic hot water heater retrofitted to constitute a hot water reservoir to supply hot water on demand.

3. An integrated water heating system as claimed in claim 2 wherein said inner tank is provided with a domestic water supply connection and a hot water outlet connection, a drain conduit secured to a lower end of said inner tank, and a pressure relief valve secured to a top wall of said inner tank.

4. An integrated water heating system as claimed in claim 1 wherein said external support bracket is a hanging bracket to which is removably hung said external water heating device.

5. An integrated water heating system as claimed in claim 4 wherein there is further provided an abutment bracket secured to an outer surface of said outer jacket and vertically aligned below said external support bracket, and an abutment flange secured to a lower portion of said hot water heating device for abutment against said abutment bracket when said hot water heating device is hung on said external support bracket.

6. An integrated water heating system as claimed in claim 5 wherein said connecting bracket is secured to said outer surface of said hot water holding tank by a strap secured about said outer surface of said hot water holding tank, said strap and connecting bracket being further held captive by said thermal insulating material which is a rigid urethane foam material expanded in said insulating space which provides bracing between said outer jacket and said hot water holding tank for said connecting bracket and said abatement bracket.

7. An integrated water heating system as claimed in claim 5 wherein said rigid urethane foam material provides a rigid support bracing structure between said outer jacket and said hot water holding tank in a region surrounding an area encompassing said external support bracket and said abutment bracket.

8. An integrated water heating system as claimed in claim 5 wherein there is further provided a further connecting bracket secured to said outer surface of said hot water holding tank and having a projecting formation provided with an arcuate connecting wall spaced a predetermined distance from said outer surface for close fit adjacent said inner surface of said outer jacket and disposed for alignment with said abutment bracket, said abutment bracket being securable to said arcuate connecting wall of said further connecting bracket through said outer jacket.

9. An integrated water heating system as claimed in claim 1 wherein said control means is a micro-controller having a temperature regulating program and a thermistor mounted to sense the temperature of the water entering said external water heating device and feeding temperature signals to said micro-controller, said micro-controller having inputting means to set a desired temperature of water within said hot water holding tank.

10. An integrated water heating system as claimed in claim 1 wherein said external water heating device is one of a tankless water heater, a heat exchanger or another type of gas or electric water heater.

11. An integrated water heating system as claimed in claim 1 wherein said projecting formation is a bracket having an arcuate connecting wall.

12. An integrated water heating system as claimed in claim 1 wherein said water heating device and conduit means feed heated recirculated water into a top end of said hot water holding tank.

* * * * *